United States Patent [19]

Burns

[11] Patent Number: 4,567,854

[45] Date of Patent: Feb. 4, 1986

[54] ROTARY LIVESTOCK CONTAINMENT CHUTE FOR USE IN VETERINARY PROCEDURES AND THE LIKE

[76] Inventor: Danny G. Burns, Rte. 3, Maryville, Mo. 64468

[21] Appl. No.: 638,016

[22] Filed: Aug. 6, 1984

[51] Int. Cl.[4] ..... A61D 3/00

[52] U.S. Cl. ..... 119/103

[58] Field of Search ..... 119/99, 103

[56] References Cited

U.S. PATENT DOCUMENTS

| | | | |
|---|---|---|---|
| 1,455,101 | 5/1923 | Barlow | 119/103 |
| 2,510,703 | 6/1950 | Linton | 119/99 |
| 2,713,326 | 7/1955 | Stephenson | 119/99 |
| 3,683,864 | 8/1972 | Priefert | 119/99 |
| 4,162,685 | 7/1979 | Knappenberger | 119/103 |

*Primary Examiner*—Hugh R. Chamblee

*Attorney, Agent, or Firm*—Schmidt, Johnson, Hovey & Williams

[57] ABSTRACT

The chute has a power-driven, rotary carriage in the nature of a stall which an animal may enter and be confined within during processing and various veterinary procedures. A lower side panel of the carriage may be removed entirely from the carriage for access to the lower extremities of the animal while it is standing on the floor of the carriage, or, if desired, the carriage may be rotated to any one of a number of possible positions, for example, 90° from an upright condition, so that the animal is essentially lying on its side within the carriage. The floor may then be completely removed or swung back out of the way for access to the lower extremities of the animal during surgical procedures. Other portions of the carriage adjacent the bottom thereof may also be entirely removed for complete, unhindered access to the lower portions of the animal at that time with the carriage serving essentially as an operating table. Sides of the carriage may be adjusted inwardly and outwardly for tighter or looser confinement as desired, and upper portions of the carriage sides in the form of sets of vertical bars may be selectively swung down out of their normal closed positions to permit access to the upper body portions of the animal when the carriage is upright.

11 Claims, 7 Drawing Figures

ROTARY LIVESTOCK CONTAINMENT CHUTE FOR USE IN VETERINARY PROCEDURES AND THE LIKE

TECHNICAL FIELD

This invention relates to the field of livestock handling and confinement equipment and, more particularly, to a special chute or stall in which such animals may be advantageously confined on an individual basis to facilitate inspection, processing, or the performance of veterinary procedures on the animal in a safe, convenient, and comfortable manner.

BACKGROUND

Cattle, hogs, and other livestock are frequently processed and inspected or otherwise treated in individual chutes having a head gate that closes against the neck of the animal behind its head once the animal is fully in place. Sides of the chute then serve to confine the animal laterally, while the head gate prevents it from moving fore-and-aft. Equipment of this type is presently available from a number of different manufacturers and suppliers, certain of which provide their equipment with removable sidewall portions and the like to facilitate access to different body portions of the animal once it is fully confined.

While confinement chutes of this type are normally adequate for the performance of routine processing operations such as hoof inspection and injections of various kinds, the performance of surgical veterinary operations on livestock has typically required the use of operating tables upon which the animal can be laid out, and suitable hoisting equipment or the like for placing the animal on such a table once it has been sedated. Operations have also been carried out by leaning the sedated animal against a tilted table or other surface, or by allowing the animal to lie on the floor while the procedures are being performed.

Although previous efforts have been made by others to provide a chute into which the animal could climb and which could then be rotated through power mechanism in order to lay the animal on its side for surgical purposes or otherwise, such prior device is unduly complicated and complex, and does not provide the access freedom which the veterinarian requires in order to perform surgical operations on the animal in a manner which is most convenient for the veterinarian.

SUMMARY OF THE PRESENT INVENTION

Accordingly, one important object of the present invention is to provide a rotating livestock chute which is not only capable of gently reorienting the confined animal from a standing position to one in which the animal is lying on its side, but which is also so designed that otherwise obstructing portions of the rotatable carriage of the chute may be removed at the discretion of the user to provide free, unfettered access by the user to different portions of the confined animal, including the lower body extremities thereof when the animal is laid on its side for surgical procedures in that area.

To this end, the present invention contemplates a chute having a rotatable carriage portion that is supported by standing, stationary frame structure. The animal is confined between opposite ends of the carriage with its head protruding through a confining head gate and its sides restricted by opposite, upright sides of the carriage. When the carriage is rotated into a position 90° from its upright position so that the animal is lying on its side, the floor of the carriage may be either hinged down for access, or completely removed from the rest of the carriage, along with other lower side portions of the carriage, to provide clear access for surgical procedures. In that condition, the carriage essentially performs as an operating table with the hoisting mechanism self-contained therein so that the effort and inconvenience of prior contrivances in this respect can be entirely avoided. Sides of the carriage can be adjusted toward and away from one another as may be necessary or desirable to accommodate animals of different sizes, upper portions of the carriage in the form of bar assemblies may be selectively swung into opened positions to permit access to the upper extremities of the animal, and the carriage may even be rotated 180° or more from its upright position so that the animal, through the use of auxiliary means, may be slung in a totally inverted position for surgical procedures in that orientation if desired.

DETAILED DESCRIPTION

Figure 4:
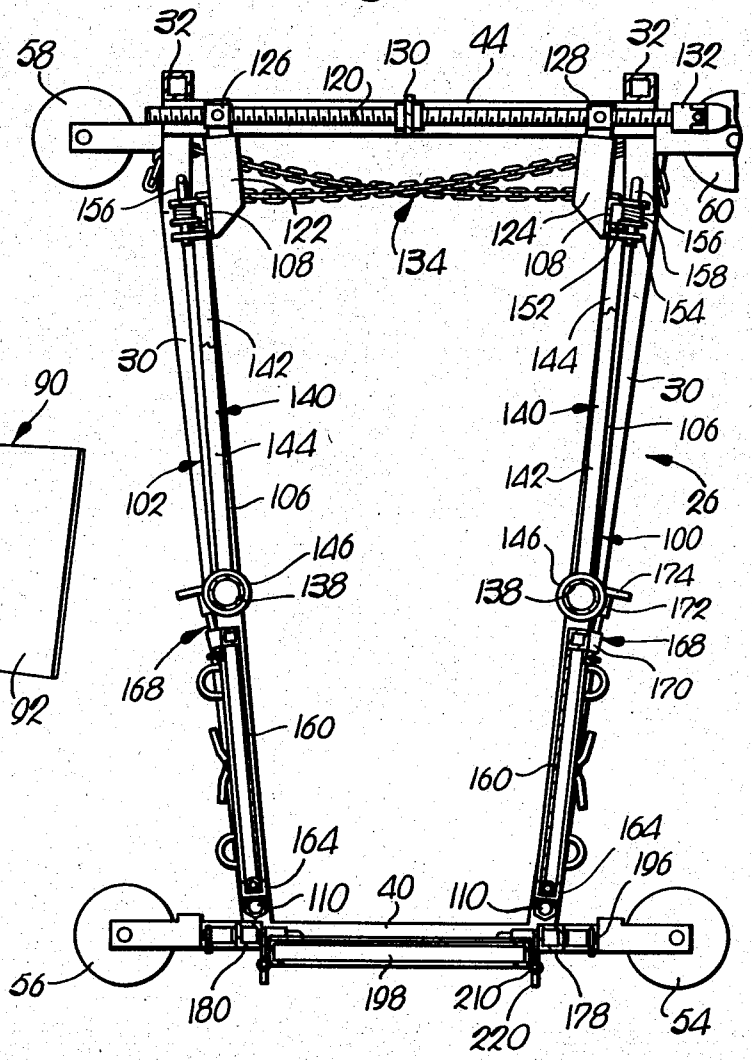
FIG. 4 is a transverse cross-sectional view of the carriage portion of the chute taken substantially along line 4—4 on FIG. 2.
Figure 1:
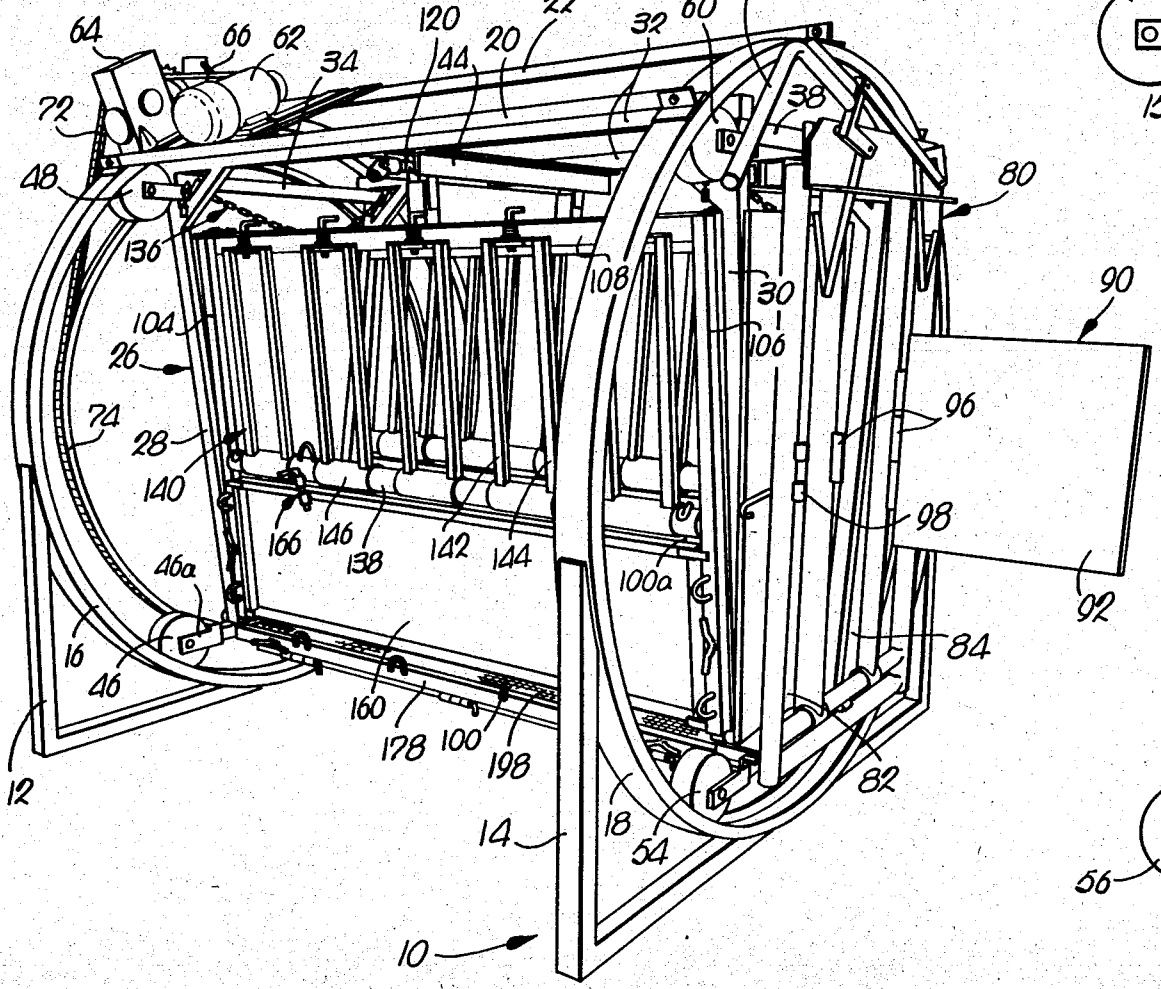
FIG. 1 is a right front perspective view of a rotary chute constructed in accordance with the principles of the present invention.
Figures 3, 6:
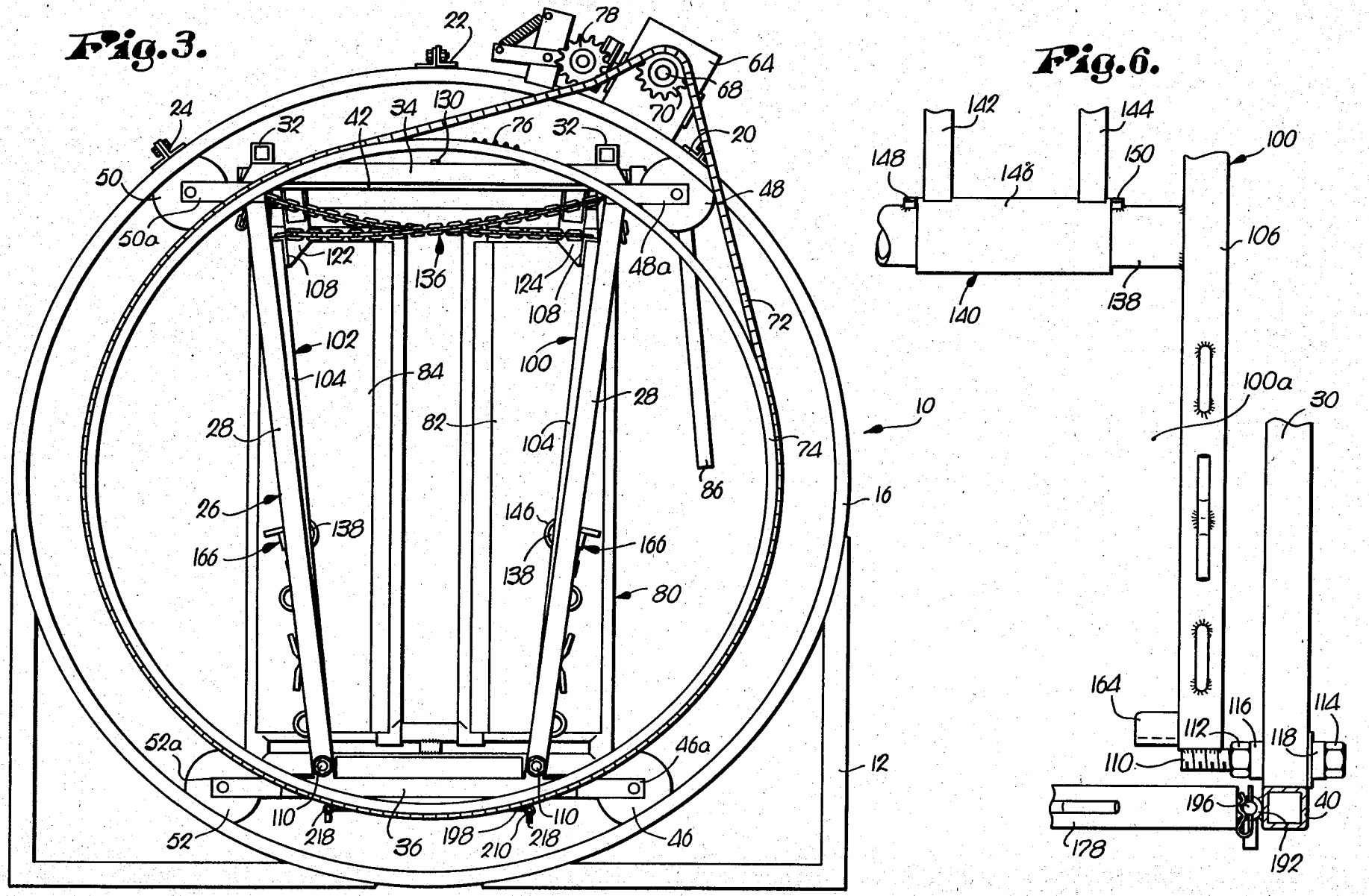
FIG. 3 is a rear elevational view of the chute.
FIG. 6 is an enlarged, fragmentary side elevational view of a lower front corner of the carriage illustrating details of construction.

Referring initially to FIG. 1, it may be seen that the device of the present invention includes a stationary frame 10 having a pair of opposite end upright sections 12 and 14, the sections 12 and 14 including circular, large diameter tracks 16 and 18, respectively. The tracks 16, 18 are joined together across the top by frame members 20, 22, and 24 (see FIG. 3 for the frame member 24), and the frame sections 12, 14 may be bolted to the floor along their lower extremities if desired. A confining carriage broadly denoted by the numeral 26 is supported within the frame 10 for rotation about a horizontal axis extending in a fore-and-aft direction through the center of the circular tracks 16 and 18. The carriage 26 has its own subframe that includes an upright rear member 28, an upright front member 30, and a horizontal top member 32 interconnecting upright members 28, 30 on each side of the carriage 26. The two upright members 28 at the rear of the carriage 26 are interconnected across the top by a transverse frame member 34 and across the bottom by a lower transverse frame member 36 (as shown in FIG. 3), while a similar construction is provided at the front of the carriage 26 as perhaps best shown in FIG. 4 wherein an upper transverse frame member 38 spans the upright members 30 across their upper ends and a lower transverse frame member 40 spans the uprights 30 across their lower ends. A pair of transversely extending angle members 42 and 44 span the upper longitudinal members 32 at their midpoints to tie the two opposite sides of the subframe together at that location. A set of four wheels 46, 48, 50, and 52 are secured to the four corners of the rear of the subframe outboard of the upright members 28 thereof and are received within the track 16 for the purpose of rotatably supporting the rear end of the carriage 26 within the frame 10. Correspondingly, a set of four wheels 54, 56, 58, and 60 are secured to four corners of the front end of the carriage subframe and are received within the track 18 at that location for the purpose of rotatably supporting the front end of the carriage 26 by the frame 10.

An electric motor 62 mounted on top of the frame 10 adjacent the rear thereof (FIG. 1) is drivingly coupled with a right-angle gearbox 64 via a drive belt 66, and the output shaft 68 (FIG. 3) of the gearbox 64 is provided with a sprocket 70 about which is entrained a long, continuous drive chain 72 looped also about a large diameter drive wheel 74 fixedly secured to the rear end of the subframe of carriage 26 such as by weldment to yoke-like wheel supports 46*a*, ,*l* 48*a*, 50*a*, and 52*a* for the wheels 46, 48, 50, and 52. Four sets of sprocket segments such as the segments 76 shown in FIG. 3 are fixed to the outer periphery of the drive wheel 74 at equally spaced locations around the latter for meshing with the drive chain 72 and insuring driving engagement of the latter with the wheel 74. A spring-loaded idler sprocket 78 mounted on the rear frame track 16 adjacent the top thereof as shown in FIG. 3 maintains suitable tension in the drive chain 72.

Figures 5, 7:
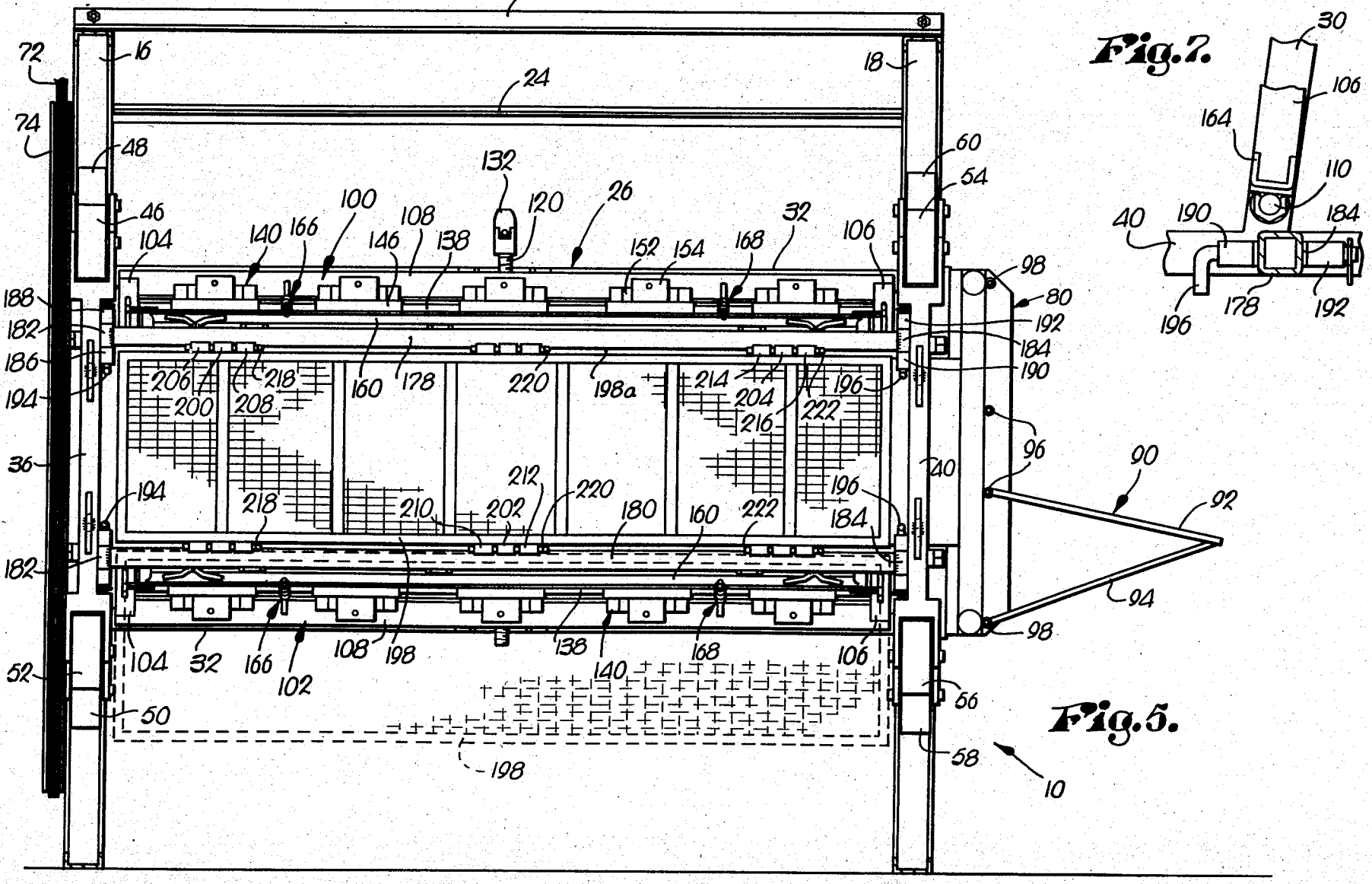
FIG. 5 is a right side elevational view of the chute with the carriage portion thereof rotated 90° out of an upright position so that the bottom of the carriage faces outwardly.
FIG. 7 is an enlarged, fragmentary detail view of the same lower corner shown in FIG. 6, but viewed from the rear thereof.

The front of the carriage 26 has a head gate broadly denoted by the numeral 80 which may be of any suitable design. For example, the head gate 80 may take the form of that sold by For-most, Inc. of Hawarden, Iowa under the trade designation "Model 30 Holding Stanchion & Catch Gate". As will be well understood by those skilled in the art, the head gate 80 has a pair of opposed, laterally shiftable clamping doors 82 and 84 which are operated by the handle 86 in FIG. 1 to clamp behind an animal's head in the usual way for containment purposes as illustrated with respect to the steer 88 shown in FIG. 2. A head table 90 is secured to the head gate 80 and includes a rectangular platform 92 positioned on one side of the opening normally defined between the two clamping doors 82 and disposed in a vertical plane when the carriage 26 is disposed in its upright position of FIG. 1. The platform 92 is steadied by a brace 94 as illustrated in FIG. 5, and the table 90 may be positioned on either side of the head gate 80 by virtue of quick-attachment means 96 and 98 provided for the platform 92 and the brace 94 respectively. Thus, as will subsequently become apparent, the table 90 may provide a support for the head of the steer 80 for either direction of rotation of the carriage 26 by simply attaching the head table 90 on the appropriate side of the head gate 80. In the position illustrated in FIG. 1, for example, the head gate 90 is positioned appropriately for rotation of the carriage 26 in a clockwise direction as veiwed from the front of the machine through 90° of travel until the position of FIG. 5 is reached.

The carriage 26 is also provided with a pair of opposite sides 100 and 102 which are of identical construction and serve to confine the animal laterally. Because of the identity in construction of the two sides 100, 102, only the side 100 will be described in detail.

The side 100 includes a pair of fore-and-aft spaced, upright structural elements 104 and 106 which are connected together at their upper ends by a transversely L-shaped structural element 108. At their lower ends, the elements 104, 106 are each provided with a fore-and-aft extending pivot bolt 110 (detailed in FIG. 6) which is journaled by the proximal upright member 28 or 30 in order to support the side 100 for inward and outward adjusting movement about the axes of the bolts 110. Each bolt 110 passes entirely through its upright member 28 or 30 and is provided with a pair of lock nuts 112 and 114 on opposite sides of the member 28 or 30, and with a pair of collars 116, 118, for rendering the side 100 slightly adjustable in a fore-and-aft sense. A transverse adjusting screw 120 across the top of the carriage 26 between the angles 42, 44 (FIGS. 1 and 4) is oppositely threaded at its two ends and is coupled with the two sides 100, 102 via brackets 122, 124 and internally threaded blocks 126, 128 secured to the brackets 122, 124 respectively and threadably receiving the opposite ends of the screw 120. The screw 120 is supported by a journal 130 at its midpoint which in turn is affixed to the angles 42, 44, and a U-joint coupling 132 affixed to the end of screw 120 above side 100 thereof is adapted to receive a detachable crank handle or the like (not shown) for the purpose of operating the screw 120. Front and rear sets of chains 134 and 136 respectively may be slung across the two sides 100, 102 at their upper extremities for assisting the screw 120 in restraining the sides 100, 102 against outward expanding movement when an animal is confined within the carriage 26.

The side 100 is also provided with a fore-and-aft extending structural tube 138 of cylindrical cross-sectional configuration positioned approximately midway between the upper and lower extremities of the side 100 and interconnecting the front and rear elements 106 and 104 at that location. Five normally upright bar assemblies 140 extend between the tube 138 and the upper fore-and-aft element 108 for the purpose of partially closing off the otherwise open rectangular area in the upper section of the side 100 defined by the elements 104, 106, 108 and the tube 138. Each of the bar assemblies 140 includes a pair of fore-and-aft spaced apart, generally upright bars 142 and 144 which are rigidly affixed at their lower ends to a sleeve 146 rotatably encircling the tube 138 and confined against fore-and-aft movement along the latter by a pair of opposed abutments 148 and 150 rigidly affixed to the tube 138 on opposite fore-and-aft sides of the sleeve 146. At their upper ends, the bars 142 and 144 are interconnected by a fore-and-aft extending rigid strap 152 which is disposed to lie slightly above a laterally outwardly projecting tang 154 on the fore-and-aft extending element 108. The tang 154 is appropriately perforated to receive the lower end of a spring-loaded locking pin 156. When the bar assembly 140 is upright, the pin 156 may pass on the outside of the strap 152 when pin 156 is retained within the tang 154, thereby retaining the upper end of the bar assembly 140 against outward movement away from the fore-and-aft element 108. On the other hand, when the pin 156 is pulled upwardly against the downward bias of its spring 158, the lower end of the pin 156 may clear the strap 152, enabling the bar assembly 140 to be swung downwardly about the tube 138 to the lowered, open position as illustrated by the bar assembly 140*a* in FIG. 2.

The lower half of the side 100 has an opening 100*a* defined beneath the tube 138 and between the uprights 104, 106 which is normally closed off by a flat panel 160 removably retained in place between the front and rear elements 106, 104 and below the tube 138. In this respect, the rear element 104 is provided with a forwardly projecting, lower, upwardly open and transversely U-shaped socket 162, while the front element 106 is provided with a lower, rearwardly extending socket 164 of identical configuration (see FIGS. 6 and 7 for details of construction). Sockets 162 and 164 receive and removably retain the lower corners of the panel 160 while the upper extremity of the latter is retained by a pair of fore-and-aft spaced keepers 166 and 168 respectively. As exemplified by the keeper 166, each of the keepers 166, 168 includes a small, generally upright sleeve 170 fixed to the panel 160, a second generally upright sleeve 172 fixed to the tube 138 directly above and in axial alignment with the sleeve 170, and a retaining pin 174 received by the two sleeves 170, 172 and suitably provided with means for preventing unintentional escape of the retaining pin 174 from the two sleeves 170, 172. A pair of rigid locating ears 176 and 177 project in fore-and-aft directions from opposite upper corners of the panel 160 and bear against the outer surfaces of the upright elements 104 and 106 to facilitate installation and replacement of the panel 160.

The carriage 26 is also provided with a bottom that is defined in part by a pair of laterally-spaced, fore-and-aft extending rails 178 and 180 generally below opposite sides 100 and 102. Each of the rails 178, 180 has single, transversely extending sleeves 182 and 184 affixed to its opposite ends as shown in the bottom view of the carriage 26 in FIG. 5. As also shown in that figure and in FIG. 7, the sleeves 182 and 184 are aligned with and inserted between a pair of corresponding sleeves 186, 188, and 190, 192 affixed to the inside face of the lower transverse members 36 and 40 respectively. Removable pins 194 and 196 are received by the aligned sets of sleeves 182, 186, 188, and 184, 190, 192, respectively, permitting the two rails 178 and 180 to be entirely removed from the carriage 26 if desired.

Further defining the bottom of the carriage 26 is a foraminous floor 198 which is attached to the lower rails 178, 180 in such a way that the floor 198 may be fully closed as illustrated in solid lines throughout the drawings, swung down to an open position as illustrated in phantom lines in FIG. 5 to expose a bottom opening 198*a* between the rails 178, 180, or completely removed from the carriage 26. In this respect, each of the rails 178, 180 has three single fore-and-aft spaced-apart hinge barrels 200, 202, and 204 depending therefrom as shown, for example in FIG. 2 (see also FIG. 5 for a bottom view of the carriage 26). On the other hand, each lateral, fore-and-aft extending extremity of the floor 198 is provided with three pairs of fore-and-aft aligned hinge barrels 206, 208; 210, 212; and 214, 216 which are aligned with and receive therebetween respective ones of the single, rail hinge barrels 200, 202, and 204. Hinge pins 218, 220, and 222 are removably received within respective sets of the hinge barrels 200, 206, 208; 202, 210, 212; and 204, 214, and 216. Thus, and due to the removable nature of the hinge pins 218, 220, and 222, the floor 198 may be either closed, swung down from either side rail 178, 180, or completely removed at the user's option.

OPERATION

Figure 2:
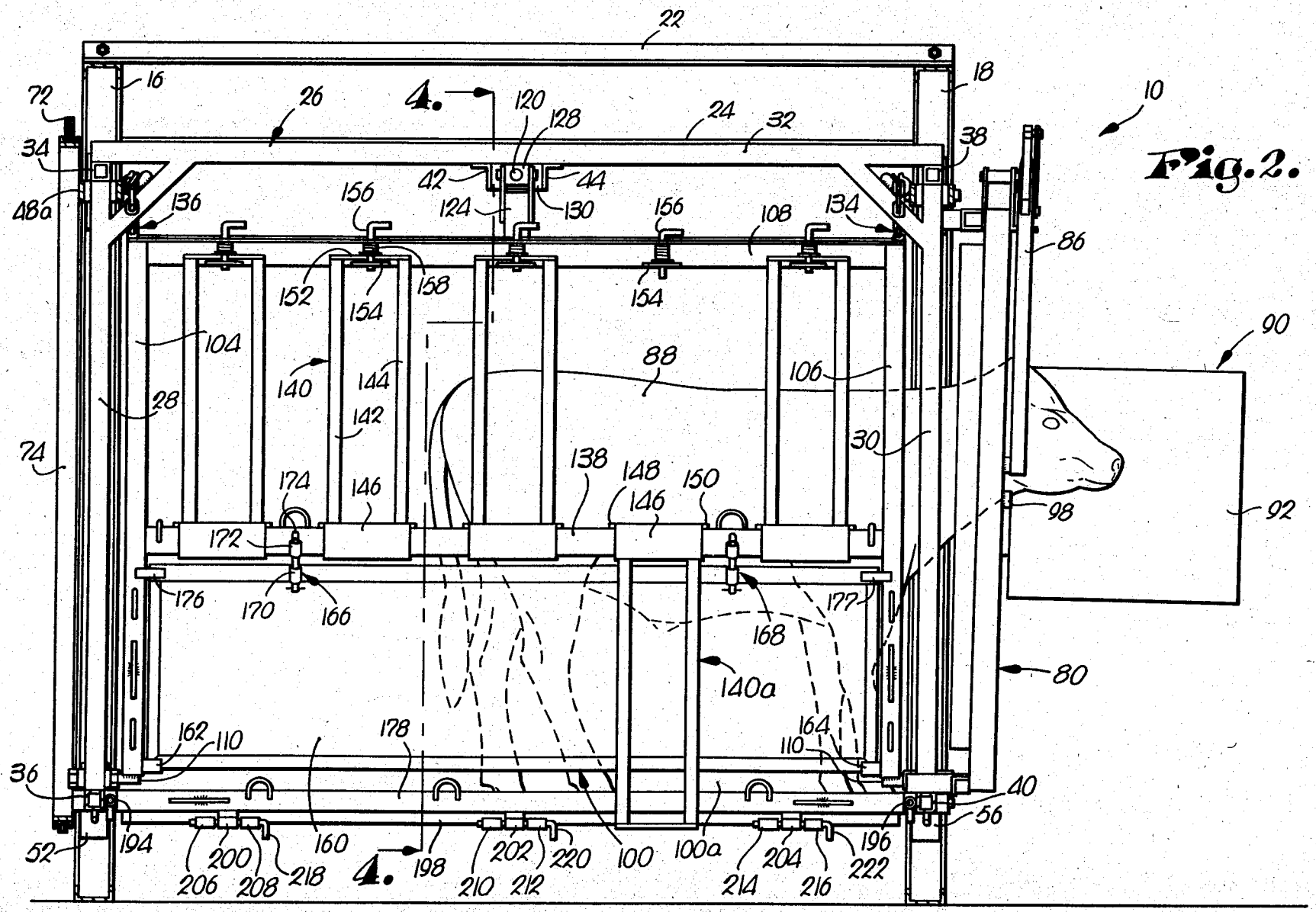
FIG. 2 is a side elevational view thereof with portions of the stationary frame removed and shown in cross section for clarity and one of the upper bar assemblies on one side of the rotary carriage lowered into an open position to illustrate access to the upper extremities of an animal confined within the chute.

With the carriage 26 disposed in its upright position as illustrated in FIG. 1, the animal is directed into the open rear end of the chute and encouraged to walk forwardly along the floor 198 until such time as its head is projecting forwardly through the head gate 80 as illustrated in FIG. 2 with respect to the steer 88. The clamping doors 82, 84 are closed by operating the handle 86, whereupon the animal is in condition for such processing and veterinary procedures as may be necessary or desirable.

In this respect, once the animal is fully contained and confined within the chute, injections may be readily administered through the spaced bars 142 and 144 to either sedate the animal for further procedures, or simply inoculate the same against infectious diseases. If further access is desired to the top portion of the animal than is available when all of the bar assemblies 140 are closed as in FIG. 1, the appropriate bar assemblies 140 may simply be dropped down to an open position as illustrated by the bar assembly 140*a* in FIG. 2 upon first releasing the pin 156 by pulling up on the latter against the action of the return spring 158. Standing cesarean operations, as well as various other kinds of surgery on the upper half of the animal can quite easily be carried out by lowering the appropriate bar assemblies 140 to provide clear access to the animal. In this respect, it will be appreciated that access can be gained to the animal from either side of the chute as may be required.

Hoof inspections and maintenance, semen testing, the treatment of mastitic cows and other procedures on the lower half of the confined animal may be more readily carried out by first removing one or both of the lower side panels 160 to expose side opening 100*a*. In this respect, it will be appreciated that to accomplish such removal it is but necessary to pull the two pins 174 for the appropriate panel 160 out of the sleeves 170, 172, and then lift the panel 160 out of its sockets 162, 164. Replacement of such removed panel is a simple reversal of this process, with the locating ears 176 and 177 coming into abutment against the upright elements 104, 106 when the panel 160 has been properly located in place, at which time the pins 174 may be easily reinserted into the aligned sleeves 170, 172.

If desired, the carriage 26 may be rotated out of its upright position to any other selected rotative position within a 360° circle of travel. In this respect, it may frequently become necessary or desirable to rotate the carriage 26 90° either clockwise or counterclockwise so as to lay the animal on its side for surgical procedures on the lower half of the animal. FIG. 5 illustrates the carriage 26 rotated 90° clockwise from its position in FIG. 1 as viewed from the front of the chute looking rearwardly, this causing the weight of the animal to be borne by the side 102 which essentially functions as an operating table under those circumstances. For convenience and ready access to the lower extremities of the confined animal, the floor 198 may be swung down to its phantom position as shown in FIG. 5 to expose bottom opening 198*a* by simply pulling the hinge pins 218, 200, and 222 associated with the lower rail 178, whereupon the floor 198 will hinge about the opposite set of pins 218, 220, and 222 associated with the other rail 180.

For even greater access, the floor 188 may be completely removed by also removing the pins 218, 220, and 222 associated with the hinges of rail 180. Furthermore, the rail 178 itself may be removed by pulling the two retaining pins 194 and 196 at opposite ends thereof, and the panel 160 may be pulled out in the manner above described. This leaves the veterinarian with unhindered access to the lower extremities of the animal through the bottom opening 198*a* and the side opening 100*a* as if the animal were lying on an operating table, yet the veterinarian has avoided the arduous task of hoisting or manually placing the animal on such table, using instead the convenient, rotary action of the carriage 26 for this purpose. Foot surgeries, X-rays, midline cesareans, and countless other surgical procedures can be readily performed with the animal sedated and oriented in this manner.

It is to be pointed out also that the extent to which the animal is confined in a lateral sense can be readily adjusted by turning the overhead adjusting screw 120 in the appropriate direction, causing the sides 100, 102 to either draw more closely together or to move further apart. By using the chains 134 and 136, additional restraining force beyond that available through simply the screw 120 and the internally threaded blocks 126, 128 can be obtained, which is of particular benefit where the animal is a large bull or steer capable of exerting extreme lateral forces on the carriage 26 during confinement.

It will also be appreciated that the rotating chute of the present invention is not limited for use with any particular animals. Swine, cows, sheep, and all other forms of livestock can be readily processed in a convenient manner through the chute of the present invention and in a way that is most accommodating for the veterinarian or livestock owner. It will be appreciated that the head table 90 is particularly beneficial where the animal is heavily sedated and procedures such as eye surgery are to be performed.

It will further be appreciated that although a single embodiment of the present invention has been disclosed herein, various minor changes could be made to the preferred embodiment by those skilled in the art without departing from the scope and spirit of the present invention.

I claim:

1. A rotary livestock containment chute comprising:

a stationary frame;

a carriage having a front and a rear end, a pair of opposite sides, and a floor normally covering a bottom opening extending from end-to-end and side-to-side of the carriage, said carriage being supported by said frame for rotation about a horizontal axis extending fore-and-aft between said ends;

power means operably coupled with said carriage for selectively rotating the latter to any one of a number of rotative positions relative to said frame and for holding the carriage at a selected position, at least one of said sides including means defining a lower, side opening extending at least substantially entirely from end-to-end of the carriage and from the floor thereof upwardly to a mid-section of said one side, said one side further including a closure portion normally closing said side opening and shiftable away from the side opening to expose the latter;

means for selectively, releasably holding said closure portion against shifting away from said side opening;

hinge means attaching said floor to the carriage adjacent the opposite side of the carriage for swinging of the floor between a closed position covering the bottom opening and an open position dropped down away from said one side of the carriage to expose the bottom opening; and means for selectively, releasably retaining the floor in its closed position, said bottom opening of the carriage and said lower, side opening thereof providing convenient access to the lower and lateral regions of an animal confined within the carriage when the carriage is rotated approximately 90° from an initial upright position with the animal standing upright on the floor to a generally horizontal, operating position with the animal layed on its side and the closure portion shifted away from the side opening and the floor swung down to its open position.

2. A rotary livestock containment chute as claimed in claim 1, wherein each of said sides is provided with means at the lower extremity thereof pivotally attaching the side to said opposite ends, said sides further being provided with mechanism operably interconnecting the sides for adjustably swinging the same toward and away from one another about said pivotal attaching means and holding the same in a selected position of adjustment.

3. A rotary livestock containment chute as claimed in claim 1, wherein said floor is provided with hinge means on each side of the carriage, said releasable retaining means comprising a removable part of each of said hinge means to permit the floor to swing to said open position when said part of one of the hinge means is removed and to be completely removed from the carriage when said part of both of said hinge means is removed.

4. A rotary livestock containment chute as claimed in claim 1, wherein each of said sides includes an upper portion comprising a plurality of upright, fore-and-aft spaced bar assemblies, each of said assemblies having a pivot at their lower ends and a latch at their upper ends, permitting the same to be selectively swung down to an access position independently of the other assemblies.

5. A rotary livestock containment chute as claimed in claim 4, wherein each of said sides includes a fore-and-aft extending mid-beam to which said assemblies are pivotally attached at their lower ends, there being a closure portion and releasable holding means for each of said sides, said releasable holding means for the closure portions each comprising selectively releasable keepers securing the corresponding closure portion to said mid-beam at the upper extremity of the closure portion.

6. A rotary livestock containment chute as claimed in claim 1, wherein said one side of the carriage further includes a lower, fore-and-aft extending member defining the lower extremity of said side opening and a lateral extremity of said bottom opening, said member being provided with means for detachably securing the same to the carriage whereby to permit complete removal of the member from the carriage for increased access to an animal within the carriage.

7. A rotary livestock containment chute as claimed in claim 6, wherein said releasable retaining means is disposed to secure said floor to said member when the floor is in said closed position and the member is attached to the carriage.

8. A rotary livestock containment chute as claimed in claim 1, wherein said releasable holding means for said closure portion includes means for detachably securing the closure portion to said one side of the carriage whereby to permit complete removal of the closure portion therefrom.

9. A rotary livestock containment chute as claimed in claim 8, wherein said one side of the carriage further includes a lower, fore-and-aft extending member defining the lower extremity of said side opening and a lateral extremity of said bottom opening, said member being provided with means for detachably securing the same to the carriage whereby to permit complete removal of the member from the carriage for increased access to an animal within the carriage.

10. A rotary livestock containment chute as claimed in claim 9, wherein both sides of the carriage are provided with respective, lower, fore-and-aft extending members defining the lower extremities of respective side openings in the two sides of the carriage and lateral extremities of said bottom of the carriage, there being hinge means for said floor on both of said members and said releasable retaining means comprising a removable part of each of said hinge means whereby to permit the floor to be swung to said open position when said part of one of the hinge means is removed and to be completely removed from the carriage when said part of both of said hinge means is removed.

11. A rotary livestock containment chute comprising:

a stationary frame;

a carriage having a front and a rear end, a pair of opposite sides, and a floor normally covering a bottom opening extending from end-to-end and side-to-side of the carriage, said carriage being supported by said frame for rotation about a horizontal axis extending fore-and-aft between said ends;

power means operably coupled with said carriage for selectively rotating the latter to any one of a number of rotative positions relative to said frame and for holding the carriage at a selected position, at least one of said sides including means defining a lower, side opening extending at least substantially entirely from end-to-end of the carriage and from the floor thereof upwardly to a mid section of said one side, said one side further including a closure portion normally closing said side opening;

means for selectively, removably holding said closure portion on the carriage covering said side opening; and means selectively, removably retaining said floor on the carriage covering the bottom opening, said bottom opening of the carriage and said lower, side opening thereof providing convenient access to the lower and lateral regions of an animal confined within the carriage when the carriage is rotated approximately 90 degrees from an initial upright position with the animal standing upright on the floor to a generally horizontal, operating position with the animal layed on its side and the closure portion and the floor completely removed from the carriage to expose said openings.

* * * * *